United States Patent [19]

Oshiage et al.

[11] Patent Number: 4,727,838

[45] Date of Patent: Mar. 1, 1988

[54] APPARATUS FOR CONTROLLING INTERNAL COMBUSTION ENGINE

[75] Inventors: Katsunori Oshiage, Yokohama; Satoshi Takizawa, Yokosuka; Nobuo Kurihara, Hitachiota; Yasunori Mouri, Katsuta, all of Japan

[73] Assignees: Hitachi, Ltd.; Nissan Motor Co., Ltd., both of Japan

[21] Appl. No.: 46,142

[22] Filed: May 5, 1987

[30] Foreign Application Priority Data

May 9, 1986 [JP] Japan ..... 61-104879

[51] Int. Cl.[4] ..... F02D 41/10

[52] U.S. Cl. ..... 123/361; 123/399; 123/492

[58] Field of Search ..... 123/361, 399, 492

[56] References Cited

U.S. PATENT DOCUMENTS 4,519,361 5/1985 Murakami ..... 123/361
4,526,153 7/1985 Hasegawa et al. ..... 123/492
4,590,564 5/1986 Ishikawa et al. ..... 123/492
4,630,206 12/1986 Amamo et al. ..... 123/492
4,640,243 2/1987 Abo et al. ..... 123/361
4,640,254 2/1987 Ninomiya ..... 123/492

*Primary Examiner*—William A. Cuchlinski, Jr.
*Attorney, Agent, or Firm*—Antonelli, Terry & Wands

[57] ABSTRACT

An apparatus for controlling an internal combustion engine comprises a position sensor for detecting an operational position of an accelerator pedal operated by a driver, a microprocessor for generating a target throttle valve opening in accordance with a predetermined function in response to the operational position of the accelerator pedal, and a servo motor provided with a throttle valve opening sensor and a servo drive circuit for controlling the opening of the throttle valve of the engine to the target throttle valve opening. In the microprocessor, there is provided a compensation circuit for compensating, during the acceleration, for the target throttle valve opening in response to the operational positions of the accelerator pedal immediately before and after the acceleration and an engine operational parameter immediately before the acceleration.

1 Claim, 15 Drawing Figures

APPARATUS FOR CONTROLLING INTERNAL COMBUSTION ENGINE

BACKGROUND OF THE INVENTION

The present invention relates to an apparatus for controlling an internal combustion engine, and more particularly to an apparatus for controlling a degree of opening of a throttle valve in accordance with a predetermined function by electrically detecting an operational position of an accelerator pedal without directly coupling the accelerator pedal and the throttle valve to each other.

Figure 7:
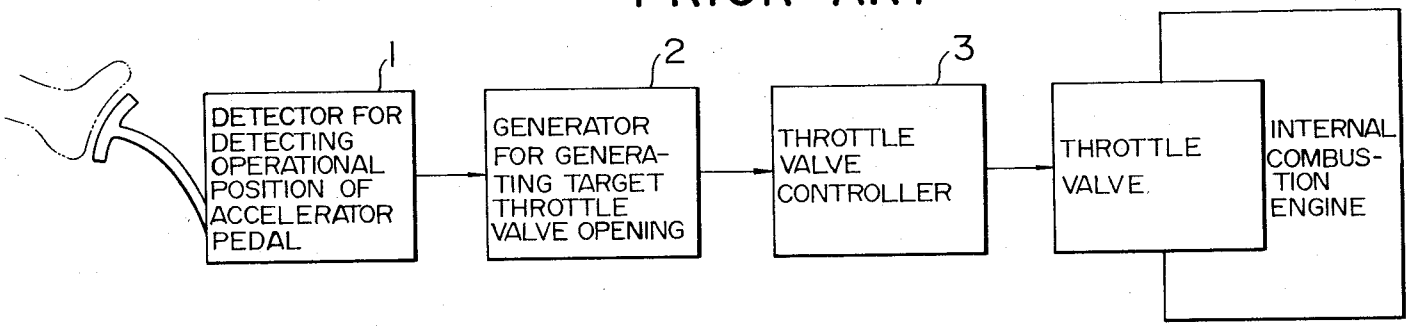
FIG. 7 PRIOR ART
FIG. 7 is a block diagram showing an apparatus of the prior art.

Such kind of a control apparatus for an internal combustion engine is disclosed, for example, in Japanese Patent Unexamined Publication No. 178940/1985, and has a structure as shown in FIG. 7.

Figure 8:
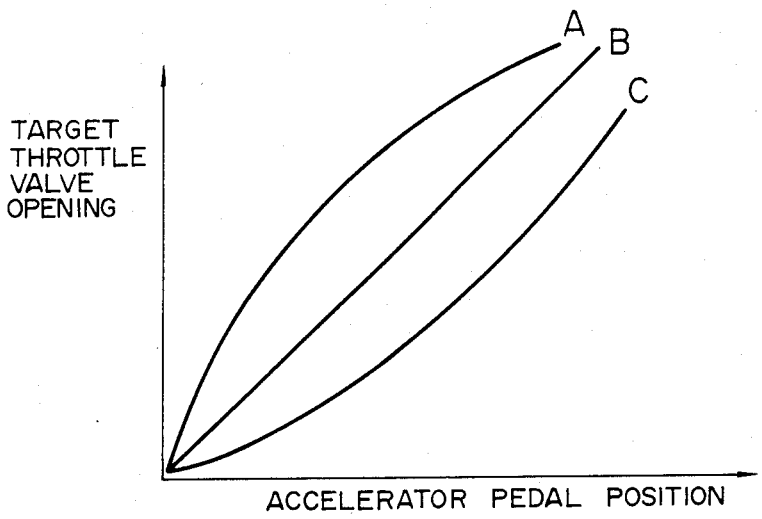
FIG. 8 is a graph showing characteristics of a target throttle valve opening with respect to an acceleration pedal operational position.

In FIG. 7, reference numeral 1 denotes a detector for detecting an operational position of an accelerator pedal operative by a driver. Reference numeral 2 denotes a generator for generating a target opening of a throttle valve in accordance with a predetermined function as shown in FIG. 8 in response to the operational position (step-in angular position) of the accelerator pedal. Also, in order to improve the driver's drive feeling, the functions A, B and C of FIG. 8 are suitably selected in accordance with the step-in speed of the accelerator pedal. The opening of the throttle valve of the internal combustion engine is controlled to the target throttle valve opening by a throttle valve controller 3.

However, such a conventional controlling apparatus for an internal combustion engine should be further improved in view of, for example, responsibility of the engine during the acceleration operation as described later.

Figure 9:
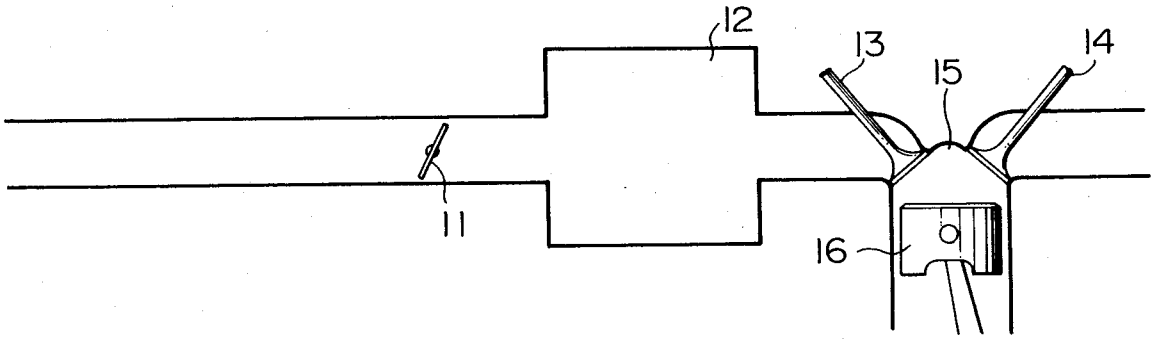
FIG. 9 is a view showing an example of an air intake controlling system for an internal combustion engine.

FIG. 9 shows an example of an air intake control system comprising a throttle valve 11, an intake manifold 12, an intake valve 13, an exhaust valve 14, a cylinder 15 and a piston 16.

Figure 10:
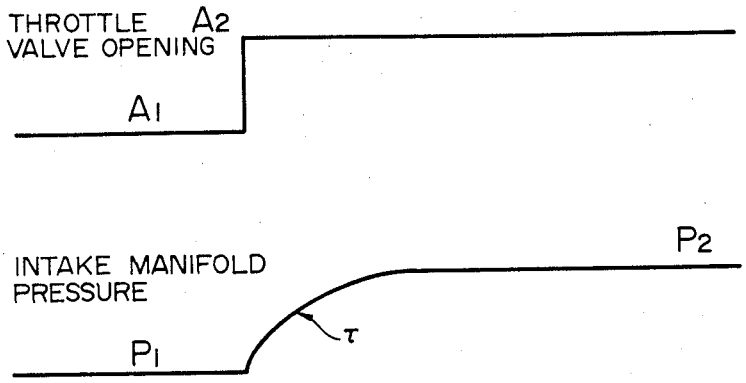
FIG. 10 PRIOR ART
FIGS. 10 and 11 are diagrams showing results according to the conventional apparatus.

Referring now to FIG. 10, a change in drawn air will be explained in the case where, in such a control system as described above, the throttle valve opening is abruptly changed.

In FIG. 10, $P_1$ is the intake manifold pressure (i.e., intake pipe vacuum pressure) in the case where the engine is driven at a throttle valve opening with a flow cross-sectional area $A_1$, and $P_2$ is the intake manifold pressure in the case where the engine is driven at an increased throttle valve opening with a flow cross-sectional area $A_2$. Also, assume that V is the volume of the intake manifold 12, Vh is the volume or displacement of the cylinder 15 and N is an engine RPM (revolutions per minute).

In the case where the accelerator pedal is stepped by the driver's foot; this condition is detected by the accelerator pedal operational position detector; a target throttle valve opening is determined in accordance with one of the functions A, B and C by the target throttle valve opening generating means; the throttle valve is opened by the throttle valve controller; and the cross-sectional area is changed stepwise from $A_1$ to $A_2$, the pressure in the intake manifold is changed from $P_1$ to $P_2$ with a responsibility of a time constant $\tau$ given by the following equation:

$$\tau = V/(C_1 \cdot A_2 + C_2 \cdot Vh \cdot N)$$

where $C_1$ and $C_2$ are constants.

Thus, the time constant $\tau$ of the responsibility of the intake manifold pressure is in proportion to the intake manifold volume V and in inverse proportion to a sum of the cross-sectional area of the throttle valve and the volume Vh·N that is the volume of the air drawn from the intake manifold into the engine.

In this case, the amount Q of the air drawn by the cylinder is given by a product ($Q = \eta \cdot P$) of the intake manifold pressure P and the charge efficiency $\eta$ determined by the engine RPM.

Accordingly, if a fuel corresponding to the intake air amount is exactly given by a carburetor or a fuel injection nozzle, the responsibility of an output torque of the engine is substantially identical with that of the intake manifold pressure (intake pipe vacuum pressure).

However, as is apparent from the foregoing equation, since the time constant $\tau$ of the responsibility of the intake manifold pressure is in inverse proportion to the flow cross-sectional area (i.e., opening of the throttle valve) when the engine RPM N is kept constant, there is a problem that the responsibility is slow in a low load region where the throttle valve is closed, resulting in slow engine response.

Figure 11:
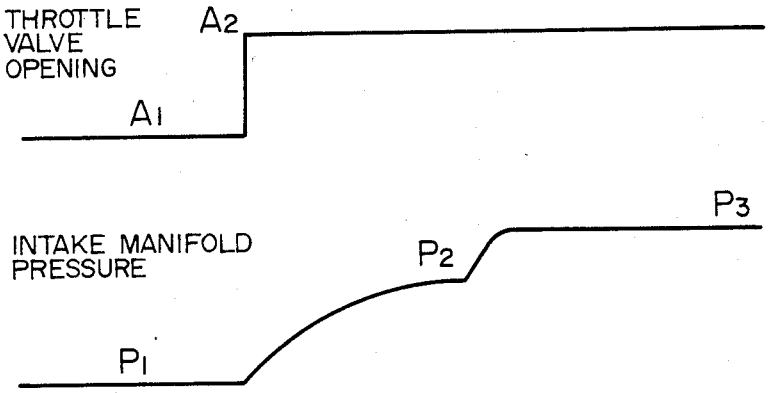
FIG. 11 PRIOR ART

Also, in case of a turbocharged engine, when the throttle valve opening is changed from $A_1$ to $A_2$ as shown in FIG. 11, the intake manifold pressure is changed from $P_1$ to $P_2$ with a responsibility of the time constant $\tau$ in the first stage. Thereafter, when the RPM of the turbocharger is increased, the supercharge is effected so that the pressure is increased to a level $P_3$. Therefore, even if the operational position of the accelerator pedal is kept constant, the acceleration is changed in two steps, which degrades the drive feeling.

SUMMARY OF THE INVENTION

Accordingly, in order to overcome the above-noted defects inherent in the conventional apparatus, an object of the present invention is to provide an apparatus for controlling an internal combustion engine, in which, during the acceleration, a throttle valve opening is compensated for, thereby enhancing a responsibility of the intake manifold pressure to improve a response of the engine.

According to the present invention, there is provided an apparatus for controlling an internal combustion engine comprising an accelerator pedal operational position detector for detecting an operational position of an accelerator pedal that is operated by a driver; a target throttle valve opening generator for generating a target throttle valve opening in accordance with a predetermined function in response to the operational position of the accelerator pedal; and a throttle valve controller for controlling an opening of a throttle valve of an engine to the target throttle valve opening, wherein means is provided for compensating, during acceleration operation, for the target throttle valve opening in response to operational positions of the accelerator pedal immediately before and after the acceleration operation and an operational parameter of the engine immediately before the acceleration.

DETAILED DESCRIPTION OF THE EMBODIMENTS

A basis structure of a controlling apparatus according to the present invention will be first described with reference to FIG. 1.

Figure 1:
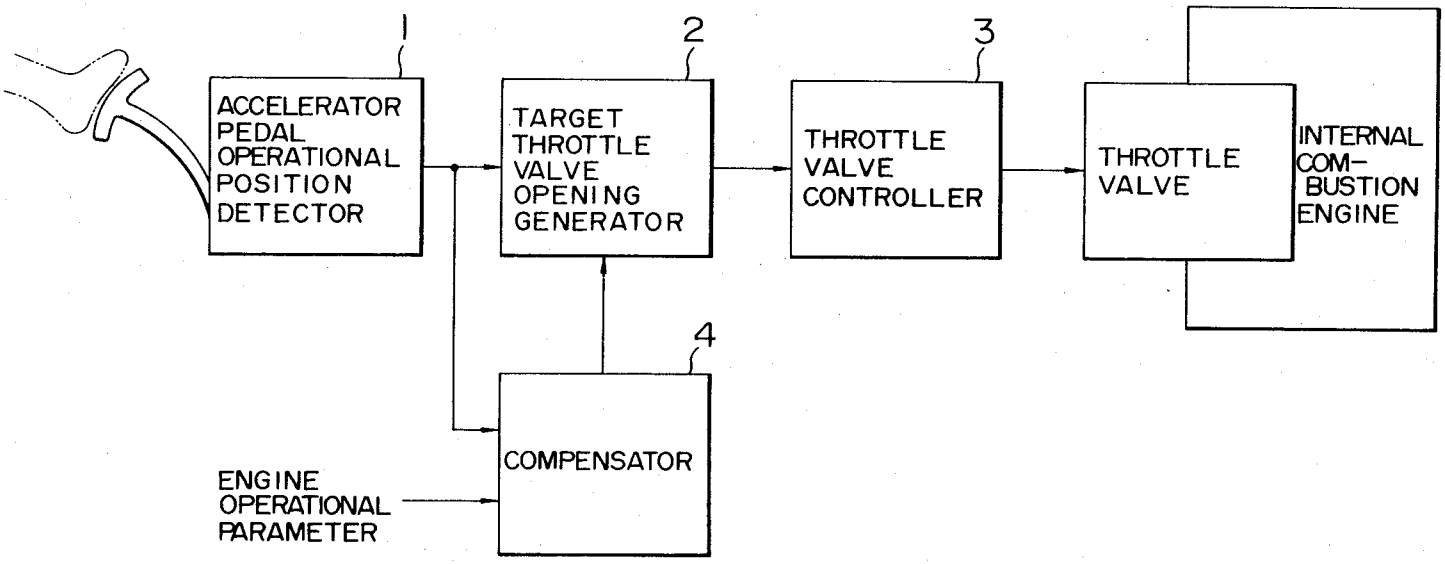
FIG. 1 is a block diagram showing the basic structure of an apparatus of the present invention.

In FIG. 1, reference numeral 1 denotes an accelerator pedal operational position detector which detects an operational position of an accelerator pedal that is actuated by the driver. A target throttle valve opening generator 2 generates a target throttle valve opening in accordance with a predetermined function in response to the operational position of the accelerator pedal. When the accelerator pedal is stepped in, compensation means or a compensator 4 compensates for the target throttle valve opening in correspondence with operational positions of the accelerator pedal immediately before and after the step-in operation and an engine operational parameter immediately before the accelerator pedal operation. The opening of an engine throttle valve is controlled to a target throttle valve opening by a throttle valve controller 3.

The operation will be described.

Figure 5A:
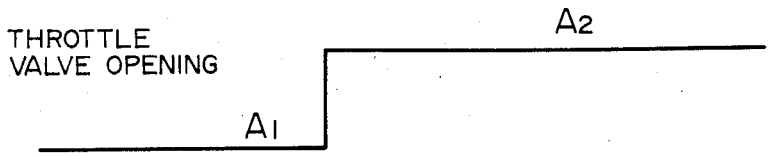
FIG. 5A PRIOR ART
FIGS. 5*a* to 5*c* are diagrams showing comparative results between the present invention and the prior art.

In a conventional apparatus, as described hereinbefore, in response to the step-in of the accelerator pedal, the opening of the throttle valve is changed stepwise as shown in FIG. 5a. Assuming that the flow cross-sectional area of the throttle valve at this time be expressed by $A_2$ and the engine RPM be expressed by N, the intake manifold pressure is changed as shown in FIG. 5c with a responsibility of a time constant $\tau$ given by the equation:

$$\tau = V(V_1 \cdot A_2 + C_2 \cdot Vh \cdot N).$$

Figure 6A:
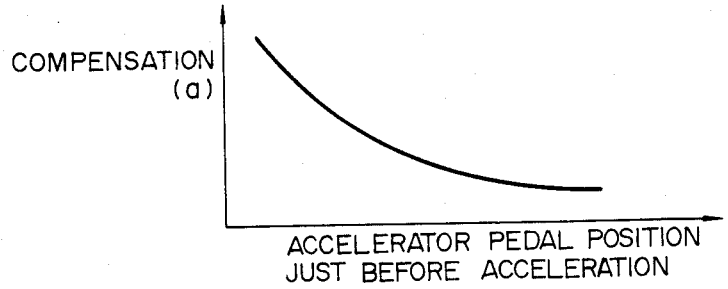
FIGS. 6*a* to 6*c* are graphs showing compensation characteristics in accordance with the invention.
Figure 6B:
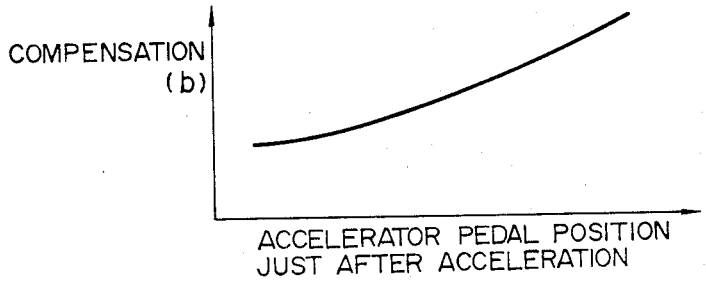
Figure 6C:
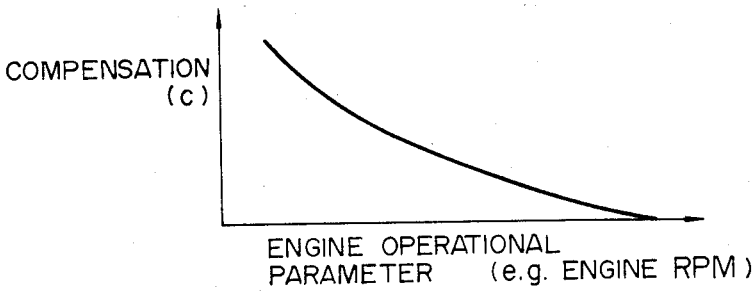

According to the present invention, the target throttle valve opening is corrected by a compensation K which is so determined that the compensation is large in a low RPM/low load range and the larger the demand for increasing the acceleration, the larger the compensation may become. Namely, the compensation means is operated in accordance with a function with respect to the accelerator pedal operational position immediately before the acceleration operation as shown in FIG. 6a, a function with respect to the accelerator pedal operational position immediately after the acceleration operation as shown in FIG. 6b and a function with respect to the engine operational parameter (e.g., engine RPM) immediately before the acceleration operation as shown in FIG. 6c.

Figure 5B:
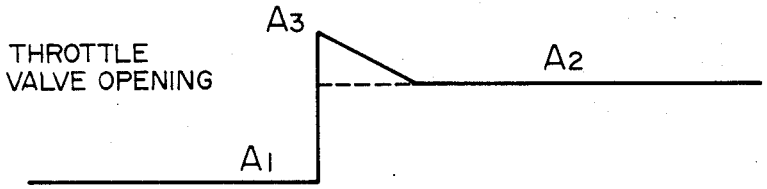
Figure 5C:
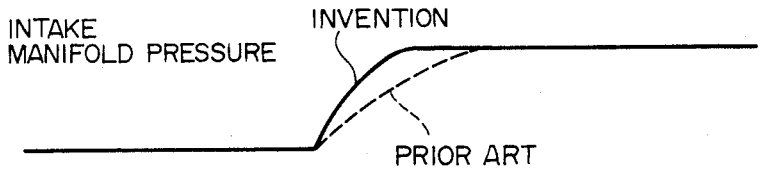

Accordingly, the throttle valve controller controls the throttle valve so that it has an opening $A_3$ which is a sum of the compensation K and the target throttle valve opening $A_2$ determined by the target throttle valve opening generator, as shown in FIG. 5b.

Thus, it is possible to obtain a responsibility of the intake manifold pressure as indicated by the solid line in FIG. 5c.

A similar control may be applied to a turbocharged engine. Namely, the throttle valve is largely opened in an initial acceleration stage, and thereafter, when the turbocharger RPM is increased, the throttle valve is closed, thus ensuring a smooth acceleration without any stepped acceleration.

An embodiment of the present invention will now be described.

Figure 2:
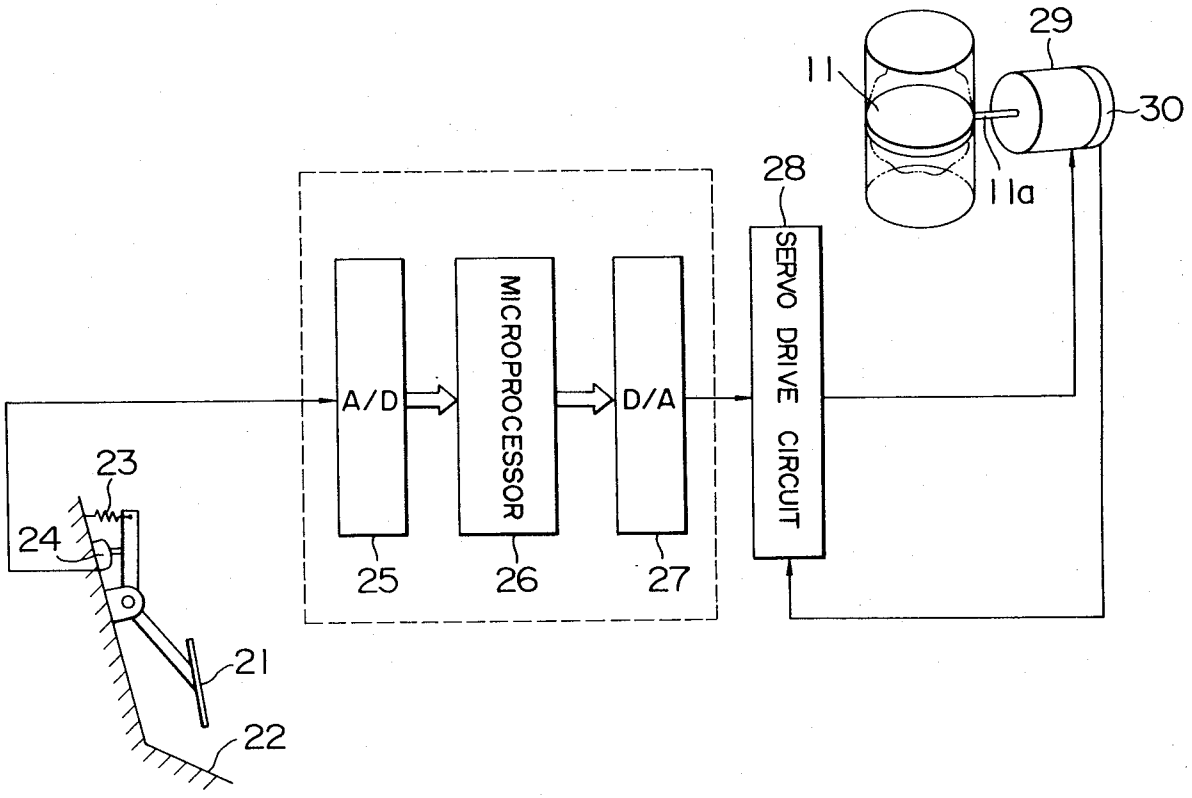
FIG. 2 is a schematic view showing an embodiment of the present invention.

In FIG. 2, an accelerator pedal 21 is pivotally supported by a floor panel 22 and is biased back to an idle position by a return spring 23. A position sensor 24 composed of a potentiometer is mounted on the floor panel 22 and is used as the accelerator pedal operational position detector. A signal outputted from this position sensor 24 is supplied to a microprocessor 26 through an A/D converter 25.

The microprocessor 26 is provided with a function for serving as the target throttle valve opening generator and the compensator on its soft wear, and is operative to determine the target throttle valve opening through a process in accordance with flowcharts of FIGS. 3 and 4 which will be explained hereinunder in detail. The thus calculated signal is outputted through a D/A converter 27 into a servo drive circuit 28.

A servo motor 29 is provided to be coupled to one end of a valve shaft 11a of a throttle valve 11. The servo motor 29 is driven by an output of the servo drive circuit 28. Also, a throttle valve opening sensor 30, which is made up of a potentiometer for detecting the throttle valve opening, is mounted on the servo motor 29 so as to be together with the servo motor 29. A signal outputted from the throttle valve opening sensor 30 is inputted into the servo drive circuit 28. The servo drive circuit 28 constitutes the throttle valve control means or controller in cooperation with the servo motor 29, and rotationally drive the servo motor 29 in a forward or a reverse direction so as to open the throttle valve 11 in correspondence with the target opening to be described later, thus controlling the throttle valve 11. Incidentally, it is possible to make up the throttle valve controller of a stepping motor or the like.

The control system will be explained with reference to the flowcharts shown in FIGS. 3 and 4.

Figure 3:
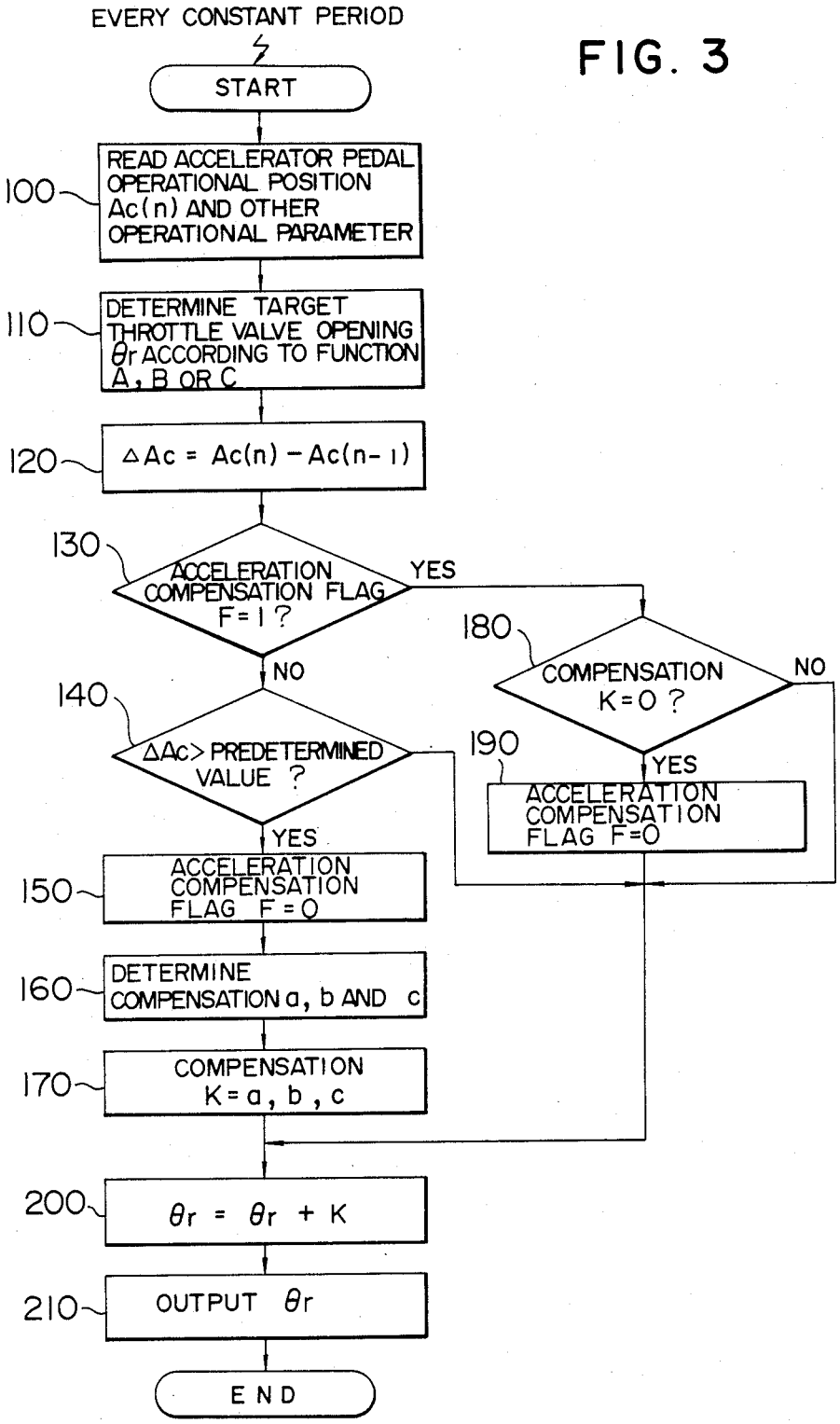
FIGS. 3 and 4 are flowcharts illustrating a controlling system in accordance with the embodiment of the invention.

The routine shown in the flowchart of FIG. 3 is to be carried out in every constant time period.

In step 100, an operational position Ac(n) of the accelerator pedal is read out on the basis of the signal from the position sensor 24, and other operational parameters such as an engine RPM are read out.

In step 110, a target throttle valve opening $\theta r$ is determined by the operational position (step-in angle) of the accelerator pedal in accordance with the function A, B or C shown in FIG. 8. Incidentally, the functions A to C are changed over in accordance with a stepping speed of the accelerator pedal. The portion of this step 110 in the microprocessor constitutes the target throttle valve opening generator.

In next step 120, a differential $\Delta Ac$ between this accelerator pedal position Ac(n) and the last accelerator pedal position Ac(n−1) is calculated.

In step 130, it is judged whether an acceleration compensation flag F is 1 or 0. If 0 is available, then the process is advanced to step 140, whereas if 1 is available, then the process is advanced to step 180.

In the case where the acceleration compensation flag F is 0, in the step 140, it is judged whether ΔAc exceeds a predetermined level or not. Namely, it is judged whether the driver demands the acceleration or not. In the case where ΔAc exceeds the predetermined level and the acceleration is demanded, steps 150, 160 and 170 are carried out, whereas in the case where any acceleration is not demanded, these steps are skipped.

In the step 150, the acceleration compensation flag F is set at 1. In the next step 160, the compensations a, b and c are set on the basis of the functions shown in FIGS. 6*a* to 6*c* in accordance with the accelerator pedal operational position immediately before the acceleration operation, the accelerator pedal operational position immediately after the acceleration operation and the operational parameter (e.g., engine RPM) immediately before the acceleration operation. In the next step 170, the compensation K is calculated as a product of these compensations a, b and c ($K=a\cdot b\cdot c$). Instead of the calculation of the product of a, b and c, it is possible to calculate the compensation by the sum of these compensations. Thereafter, the process is advanced to step 200.

In the case where in the step 130, the acceleration compensation flag F is 1, the process is advanced to step 180 thereby judging whether the compensation K is 0 or not. If K is 0, the acceleration compensation flag F is made 0 in step 190 and the process is advanced to step 200, whereas if K is not 0, the process is advanced directly to the step 200.

In the step 200, the compensation K is added to the target throttle valve opening θr, thereby determining a new target throttle valve opening θr. The portion of this step 200 in the microprocessor constitutes the compensator.

In next step 210, a signal corresponding to the new throttle valve opening θr is outputted, and is applied to the servo drive circuit 28 through the D/A converter 27, so that the throttle valve 11 is controlled to the target throttle valve opening θr by means of the servo motor 29.

Figure 4:
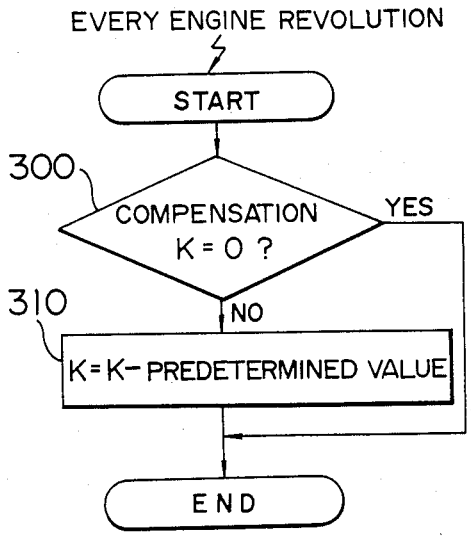

On the other hand, the routine shown in the flowchart of FIG. 4 is carried out in every revolution of the engine. In step 300, it is judged whether the compensation K is 0 or not. In the case where K is 0, this routine is completed, whereas in the case where K is not 0, the process is advanced to step 310 where a predetermined value is subtracted from the present value of the compensation K. Therefore, the compensation K which has been set in the acceleration operation is decreased gradually with the revolution of the engine, and becomes 0 at last. Also, it is possible to determine the reduction rate of the compensation K in consideration of other engine operational parameters such as the intake air amount. Thus, the characteristics shown by the solid lines in FIGS. 5*b* and 5*c* may be obtained.

As described above, according to the invention, during the acceleration operation, the throttle valve opening is compensated for in response to the operational positions of the accelerator pedal immediately before and after the acceleration. It is possible, therefore, to enhance the responsibility of the intake manifold pressure even in a low load region where the throttle valve is kept closed, thus improving the response of the engine. Also, in case of a turbocharged engine, it is possible to generate an output torque in response to the operational position of the accelerator pedal, thus keeping the acceleration constant and improving the drive feeling.

What is claimed is:

1. An apparatus for controlling an internal combustion engine comprising an accelerator pedal operational position detector for detecting an operational position of an accelerator pedal that is operated by a driver; a target throttle valve opening generator for generating a target throttle valve opening in accordance with a predetermined function in response to the operational position of the accelerator pedal; and a throttle valve controller for controlling an opening of a throttle valve of an engine to said target throttle valve opening, wherein means is provided for compensating, during acceleration operation, for the target throttle valve opening in response to operational positions of the accelerator pedal immediately before and after the acceleration operation and an operational parameter of the engine immediately before the acceleration.

* * * * *